US005873994A

United States Patent [19]

Drake et al.

[11] Patent Number: 5,873,994

[45] Date of Patent: Feb. 23, 1999

[54] PROCESS FOR AROMATIZATION OF A CRACKED GASOLINE FEEDSTOCK USING A CATALYST CONTAINING AN ACID LEACHED ZEOLITE AND TIN

[75] Inventors: Charles A. Drake, Nowata; An-hsiang Wu, Bartlesville, both of Okla.

[73] Assignee: Phillips Petroleum Company, Bartlesville, Okla.

[21] Appl. No.: 892,800

[22] Filed: Jul. 15, 1997

[51] Int. Cl.[6] ..... C10G 35/095

[52] U.S. Cl. ..... 208/135; 208/134; 585/407; 585/410; 585/411; 585/415; 585/430; 585/435; 502/352

[58] Field of Search ..... 208/134, 135; 585/407, 410, 411, 415, 430, 435; 502/352

[56] References Cited

U.S. PATENT DOCUMENTS

| | | | |
|---|---|---|---|
| Re. 29,948 | 3/1979 | Dwyer et al. | 208/110 |
| 2,212,035 | 10/1940 | Morrell et al. | 585/407 |
| 3,766,291 | 10/1973 | Drehman | 260/673.5 |
| 3,855,115 | 12/1974 | Morrison | 208/135 |
| 4,278,827 | 7/1981 | Chu et al. | 585/467 |
| 5,030,782 | 7/1991 | Harandi et al. | 585/322 |
| 5,384,296 | 1/1995 | Tsao | 502/66 |
| 5,800,696 | 9/1998 | Drake et al. | 208/135 |
| 5,804,059 | 9/1998 | Wu et al. | 208/135 |

*Primary Examiner*—Walter D. Griffin
*Assistant Examiner*—Nadine Preisch
*Attorney, Agent, or Firm*—Charles W. Stewart

[57] ABSTRACT

An aromatization process for converting a portion of a cracked gasoline feedstock to aromatics utilizing a catalyst comprising an acid leached zeolite and tin under process conditions suitable for converting a portion of the cracked gasoline feedstock to aromatics.

26 Claims, No Drawings

PROCESS FOR AROMATIZATION OF A CRACKED GASOLINE FEEDSTOCK USING A CATALYST CONTAINING AN ACID LEACHED ZEOLITE AND TIN

BACKGROUND OF THE INVENTION

The invention relates to an aromatization process for converting a cracked gasoline feedstock to yield incremental aromatics with a low rate of coke formation during the conversion of such cracked gasoline feedstock using a modified zeolite material.

It is known to catalytically crack heavy hydrocarbons, particularly hydrocarbons in the gas oil boiling range, to lower boiling hydrocarbons such as those that are in the gasoline boiling range. Specifically, the reaction products of the catalytic cracking processes contain a multitude of hydrocarbons such as unconverted $C_5$+ alkanes, lower alkanes (methane, ethane, propane), lower alkenes (ethylene and propylene), $C_6$–$C_8$ aromatic hydrocarbons (benzene, toluene, xylenes, and ethylbenzene), and $C_9$+ aromatic hydrocarbons. It can be desirable to further process the cracked gasoline product from a catalytic cracking process in order to increase the yield of more valuable aromatic compounds. This may be done with the use of certain zeolite catalyst materials.

One concern with the use of zeolite catalysts in the conversion of hydrocarbons to aromatic hydrocarbons, or lower olefins, or both, is the excessive production of coke during the conversion reaction. Coke formed during the zeolite catalyzed aromatization of hydrocarbons tends to cause catalyst deactivation. It is desirable to improve processes for the aromatization of hydrocarbons and the formation of lower olefins from hydrocarbons by minimizing the amount of coke formed during such processes. It is also desirable to have a zeolite catalyst that is useful in producing significant quantities of the aromatic and olefin conversion products.

SUMMARY OF THE INVENTION

It is an object of this invention to at least partially convert hydrocarbons, in particular, a cracked gasoline feedstock, to ethylene, propylene and BTX (benzene, toluene, xylene and ethylbenzene) aromatics.

A further object of this invention is to provide an aromatization process for the conversion of at least a portion of a cracked gasoline feedstock to aromatics in which the rate of coke formation during such conversion is minimized.

Another object of this invention is to provide hydrocarbon conversion processes which have an acceptably low coke production rate and/or which produce a conversion product containing suitable quantities of olefins and BTX aromatics.

Accordingly, the invention is an aromatization process for converting at least a portion of a cracked gasoline feedstock to aromatics. The cracked gasoline feedstock is contacted with a catalyst that comprises an acid leached zeolite and tin. The aromatization reaction conditions under which the cracked gasoline feedstock is contacted with the catalyst are such that at least a portion of the cracked gasoline feedstock is converted to aromatics.

Other objects and advantages of the invention will become apparent from the detailed description and the appended claims.

DETAILED DESCRIPTION OF THE INVENTION

A critical aspect of the inventive aromatization process is the use of a catalyst containing a zeolite material that has been treated with an acid. As used herein and in the claims, the term "acid treated zeolite", or "acid leached zeolite", is a zeolite starting material that has been treated with an acid. The acid treated zeolite is further modified by the incorporation of tin metal to give the catalyst necessary for use in the inventive process.

Any suitable means or method can be used to treat the zeolite starting material with acid. It is preferred for the zeolite to be soaked in an acid solution by any suitable means known in the art for contacting the zeolite with such acid solution. The acid solution used to treat the zeolite can be a solution of any acid that suitably provides for the leaching of aluminum atoms from the zeolite particles. Preferably, the acid concentration in this solution is about 1–10 equivalents per liter. Examples of such suitable acids include sulfuric, phosphoric, nitric and hydrochloric. The preferred acid solution is aqueous hydrochloric acid. The zeolite is soaked in the acid solution (preferably at a temperature of about 50°–100° C.) for a period upwardly to about 15 hours, but, preferably from 0.1 hour to 12 hours. After soaking, the resultant acid treated zeolite is washed free of the acid and then can be dried or calcined, or both.

The zeolite starting material used in the composition of the invention can be any zeolite which is effective in the conversion of non-aromatic hydrocarbons to aromatic hydrocarbons. Preferably, the zeolite has a constraint index (as defined in U.S. Pat. No. 4,097,367, which is incorporated herein by reference) in the range of about 0.4 to about 12, preferably about 2–9. Generally, the molar ratio of $SiO_2$ to $Al_2O_3$ in the crystalline framework of the zeolite is at least about 5:1 and can range up to infinity. Preferably the molar ratio of $SiO_2$ to $Al_2O_3$ in the zeolite framework is about 8:1 to about 200:1, more preferably about 12:1 to about 100:1. Preferred zeolites include ZSM-5, ZSM-8, ZSM-11, ZSM-12, ZSM-35, ZSM-38, and mixtures thereof. Some of these zeolites are also known as "MFI" or "Pentasil" zeolites. The presently more preferred zeolite is ZSM-5.

The catalyst further includes, in addition to the acid leached zeolite, tin either in elemental form or in the form of a tin-containing compound or any other suitable form. The tin may be incorporated into the acid leached zeolite by any suitable means or method known in the art for incorporating metallic elements into a substrate material. A preferred method is the use of any standard incipient wetness technique for impregnating the acid leached zeolite substrate with the metal. The preferred method uses a liquid impregnation solution containing the desirable concentration of tin so as to ultimately provide the final catalyst composition having the required concentration of tin.

It is particularly desirable to use for the impregnation of the acid treated zeolite an aqueous solution or a non-aqueous solution of tin, but any suitable tin-containing solution may be used. The preferred impregnation solution is a non-aqueous solution formed by dissolving a tin metal salt in cyclohexane. However, it is acceptable to use a mildly acidic solution to aid in the dissolution of the metal salt. The preferred tin compound is tributyltin acetate.

The amount of tin incorporated or impregnated into the acid treated zeolite should be such as to give a concentration effective in providing the desirable properties of favorable aromatics and olefin conversion yields with low coke production when the catalyst composition is employed in the conversion of a hydrocarbon feed. Generally, the weight percent of tin present in the impregnated acid treated zeolite is in the range upwardly to about 10 weight percent of the impregnated acid treated zeolite. The preferred concentration of tin in the impregnated acid treated zeolite is in the range of from about 0.05 to about 8 weight percent and, most favorably, from 0.1 to 6 weight percent.

The catalyst composition described herein can also contain an inorganic binder (also called matrix material) preferably selected from the group consisting of alumina, silica, alumina-silica, aluminum phosphate, clays (such as bentonite), and mixtures thereof. The content of the impregnated acid treated zeolite component of the mixture of impregnated acid treated zeolite and inorganic binder is about 50–99 (preferably about 50–80) weight-%, and the content of the above-listed inorganic binders in the mixture of impregnated acid treated zeolite and inorganic binder is about 1–50 weight-%. Generally, the impregnated acid treated zeolite and inorganic binder components are compounded and subsequently shaped (such as by pelletizing, extruding or tableting). Generally, the surface area of the compounded composition is about 50–700 $m^2/g$, and its particle size is about 1–10 mm.

The impregnated acid treated zeolite can be subjected to a heat treating step whereby it is exposed by any suitable method known in the art to a gas atmosphere under temperature and pressure conditions and for a period of time that suitably provides a desired heat treated material. The gas used in the heat treatment of the impregnated acid treated zeolite can be selected from the group consisting of inert gases (for example, nitrogen, helium and argon gases), reducing gases (for example, carbon monoxide and hydrogen gases), air, oxygen and steam. The preferred gas is selected from the group consisting of air, oxygen, nitrogen, steam and mixtures thereof. Most preferably, the treatment gas is selected from the group consisting of air, oxygen, nitrogen and mixtures of one or two thereof.

The heat treatment may be conducted at any pressure and temperature conditions that suitably provide the heat treated material. Generally, the heat treatment may be conducted at a pressure from below atmospheric upwardly to about 1000 pounds per square inch absolute (psia). More typical pressures, however, are in the range of from or about atmospheric to or about 100 psia. The heat treatment temperature is generally in the range of from about 30° C. to about 1000° C. Preferably, this temperature range is from about 40° C. to about 800° C. and, most preferably, the heat treatment temperature is in the range of from 50° C. to 600° C.

The time period for conducting the heat treatment step must be sufficient to provide a substantially dry, i.e., free of water, material. Generally, the period for exposing the impregnated acid treated zeolite to the atmosphere at appropriate temperature conditions can range from about 0.1 hour to about 30 hours. Preferably, the heat treatment step is conducted for a period of from about 0.25 hour to about 25 hours and, most preferably, from 0.5 hour to 20 hours.

An important aspect of the inventive process is that it applies only to the conversion of cracked hydrocarbon feedstocks to aromatics. The preferred feedstocks of the inventive process are cracked hydrocarbon feedstocks from the catalytic cracking (e.g., fluidized catalytic cracking and hydrocracking) of gas oils and the thermal cracking of light hydrocarbons, naphthas, gas oils, reformates and straight-run gasoline. The cracked gasoline feedstock generally comprises paraffins (alkanes) and/or olefins (alkenes) and/or naphthenes (cycloalkanes), wherein each of these hydrocarbons contains 2–16 carbon atoms per molecule. The most preferred feed for the inventive process is a cracked gasoline feedstock, derived from the fluidized catalytic cracking of a gas oil, suitable for use as at least a gasoline blend stock generally having a boiling range of from about 80° F. to about 430° F. The boiling range of the cracked hydrocarbon feedstock is determined by the standard ASTM method for measuring the initial boiling point and the end-point temperatures. Generally, the content of paraffins exceeds the combined content of olefins, naphthenes and aromatics (if present). The inventive process is principally directed to the aromatization of a cracked hydrocarbon feedstock, and it is specifically noted that the alkylation of aromatic compounds is substantially absent either because the reaction does not significantly take place or insubstantial quantities of aromatics are present in the feedstock of the inventive process.

The cracked hydrocarbon feedstock can be contacted by any suitable manner with the catalyst composition described herein contained within a reaction zone. The contacting step can be operated as a batch process step or, preferably, as a continuous process step. In the latter operation, a solid catalyst bed or a moving catalyst bed or a fluidized catalyst bed can be employed. Any of these operational modes have advantages and disadvantages, and those skilled in the art can select the one most suitable for a particular feed and catalyst.

The contacting step is preferably carried out within a conversion reaction zone, wherein is contained the catalyst composition, and under reaction conditions that suitably promote the formation of olefins, preferably light olefins, and aromatics, preferably BTX, from at least a portion of the hydrocarbons of the cracked hydrocarbon feedstock. The reaction temperature of the contacting step is more particularly in the range of from about 400° C. to about 800° C., preferably, from about 450° C. to about 750° C. and, most preferably, from 500° C. to 700° C. The contacting pressure can range from subatmospheric pressure upwardly to about 500 psia, preferably, from about atmospheric to about to about 450 psia and, most preferably, from 20 psia to 400 psia.

The flow rate at which the cracked hydrocarbon feedstock is charged to the conversion reaction zone is such as to provide a weight hourly space velocity ("WHSV") in the range upwardly to about 1000 $hour^{-1}$. The term "weight hourly space velocity", as used herein, shall mean the numerical ratio of the rate at which a cracked hydrocarbon feedstock is charged to the conversion reaction zone in pounds per hour divided by the pounds of catalyst contained in the conversion reaction zone to which the hydrocarbon is charged. The preferred WHSV of the feed to the conversion reaction zone or contacting zone can be in the range of from about 0.25 $hour^{-1}$ to about 250 $hour^{-1}$ and, most preferably, from 0.5 $hour^{-1}$ to 100 $hour^{-1}$.

The following examples are presented to further illustrate this invention and are not to be construed as unduly limiting its scope.

EXAMPLE I

This example illustrates the preparation of several catalysts which were subsequently tested as catalysts in the conversion of a gasoline sample, which had been produced in a commercial fluidized catalytic cracking unit (FCC), to aromatics.

Catalyst A—Zeolite

Catalyst A was a commercially available ZSM-5 catalyst provided by United Catalysts Inc. of Louisville, Ky. under their product designation "T-4480".

Catalyst B—Acid Leached Zeolite

A commercially available ZSM-5 catalyst (provided by United Catalysts Inc., Louisville, Ky., under product designation "T-4480" was treated by acid leaching. To acid leach the catalyst, it was soaked in an aqueous HCl solution, having a concentration of about 19 weight percent HCl for two hours at a constant temperature of about 90° C. After soaking, the catalyst was separated from the acid solution and thoroughly washed with water and dried. The acid soaked, washed and dried catalyst was calcined at a temperature of about 525° C. for four hours.

Catalyst C

A 10 gram quantity of above-described acid leached ZSM-5 catalyst was impregnated by an incipient wetness technique with an 6.26 gram quantity of a solution containing 10 weight percent tributyltin acetate in a cyclohexane solvent. This impregnated, acid leached zeolite was then dried in air and calcined at a temperature of about 538° C. for 6 hours. The final product contained 2.122 weight percent tin.

EXAMPLE II

This example illustrates the use of the zeolite materials described in Example I as catalysts in the conversion of a gasoline feed to incremental aromatics such as benzene, toluene and xylenes (BTX) and lower olefins (ethylene, propylene).

For each of the test runs, a 5.0 g sample of the catalyst materials described in Example I was placed into a stainless steel tube reactor (length: about 18 inches; inner diameter: about 0.5 inch). Gasoline boiling range feedstock from a catalytic cracking unit of a refinery was passed through the reactor at a flow rate of about 14 ml/hour, at a temperature of about 600° C. and at atmospheric pressure (about 0 psig). The formed reaction product exited the reactor tube and passed through several ice-cooled traps. The liquid portion remained in these traps and was weighed, whereas the volume of the gaseous portion which exited the traps was measured in a "wet test meter". Liquid and gaseous product samples (collected at hourly intervals) were analyzed by means of a gas chromatograph. Results of the test runs for Catalysts A through C are summarized in Table I. All test data were obtained after 8 hours on stream.

TABLE I

| Catalyst | Description | BTX Yield | Light Olefin Yield* | Sum of BTX and olefin | Ratio of BTX to olefin | Percent Coke |
|---|---|---|---|---|---|---|
| A (Control) | Zeolite | 42 | 19 | 61 | 2.2 | 4.4 |
| B (Control) | Acid Leached Zeolite | 48 | 15 | 63 | 3.2 | 1.7 |
| C (Invention) | Acid Leached Zeolite and Tin | 51 | 14 | 65 | 3.6 | 0.8 |

*Ethylene + Propylene

The test data presented in Table 1 show that the inventive process produced considerably less coke (which results in excessive catalyst deactivation) than Control Catalysts A and B and yielded more BTX and olefin with a greater ratio of BTX to olefin than the control catalysts.

Reasonable variations, modifications, and adaptations can be made within the scope of the disclosure and the appended claims without departing from the scope of this invention.

That which is claimed is:

1. An aromatization process for converting at least a portion of a cracked gasoline feedstock to aromatics, said aromatization process comprises:

contacting said cracked gasoline feedstock with a catalyst consisting essentially of an acid leached zeolite and tin under process conditions suitable for converting at least a portion of said cracked gasoline feedstock to aromatics.

2. An aromatization process as recited in claim 1 wherein the concentration of the tin in said catalyst is in the range of less than about 10.0 weight percent of said catalyst.

3. An aromatization process as recited in claim 1 wherein said catalyst is prepared by impregnating said acid leached zeolite with a tin-containing compound and thereafter heat treating the thus impregnated acid leached zeolite to thereby form said catalyst.

4. An aromatization process as recited in claim 2 wherein the source of said tin of said catalyst is tributyltin acetate.

5. An aromatization process as recited in claim 3 wherein said tin-containing compound is tributyltin acetate.

6. An aromatization process as recited in claim 4 wherein the concentration of the tin in said catalyst is in the range of from about 0.05 to about 8 weight percent of said catalyst.

7. An aromatization process as recited in claim 6 wherein the concentration of the tin in said catalyst is in the range of from 0.1 to 6 weight percent of said catalyst.

8. An aromatization process as recited in claim 7 wherein the process conditions include a contacting temperature in the range of from about 400° C. to about 800° C., a contacting pressure in the range of from subatmospheric pressure upwardly to about 500 psia, and a weight hourly space velocity in the range upwardly to about 1000 $hour^{-1}$.

9. An aromatization process as recited in claim 8 wherein said cracked gasoline feedstock is derived from the fluidized catalytic cracking of a gas oil and has a boiling range of from about 80° F. to about 430° F.

10. An aromatization process as recited in claim 5 wherein the concentration of the tin in said catalyst is in the range of from about 0.05 to about 8 weight percent of said catalyst.

11. An aromatization process as recited in claim 10 wherein the concentration of the tin in said catalyst is in the range of from 0.1 to 6 weight percent of said catalyst.

12. An aromatization process as recited in claim 11 wherein the process conditions include a contacting temperature in the range of from about 400° C. to about 800° C., a contacting pressure in the range of from subatmospheric pressure upwardly to about 500 psia, and a weight hourly space velocity in the range upwardly to about 1000 $hour^{-1}$.

13. An aromatization process as recited in claim 12 wherein said cracked gasoline feedstock is derived from the fluidized catalytic cracking of a gas oil and has a boiling range of from about 80° F. to about 430° F.

14. An aromatization process for converting at least a portion of a cracked gasoline feedstock to aromatics,. said aromatization process comprises:

contacting said cracked gasoline feedstock with a catalyst having an absence of a platinum group component comprising an acid leached zeolite and tin under process conditions suitable for converting at least a portion of said cracked gasoline feedstock to aromatics.

15. An aromatization process as recited in claim 14 wherein the concentration of the tin in said catalyst is in the range of less than about 10.0 weight percent of said catalyst.

16. An aromatization process as recited in claim 14 wherein said catalyst is prepared by impregnating said acid leached zeolite with a tin-containing compound and thereafter heat treating the thus impregnated acid leached zeolite to thereby form said catalyst.

17. An aromatization process as recited in claim 15 wherein the source of said tin of said catalyst is tributyltin acetate.

18. An aromatization process as recited in claim 16 wherein said tin-containing compound is tributyltin acetate.

19. An aromatization process as recited in claim 17 wherein the concentration of the tin in said catalyst is in the range of from about 0.05 to about 8 weight percent of said catalyst.

20. An aromatization process as recited in claim 19 wherein the concentration of the tin in said catalyst is in the range of from 0.1 to 6 weight percent of said catalyst.

21. An aromatization process as recited in claim 20 wherein the process conditions include a contacting temperature in the range of from about 400° C. to about 800° C., a contacting pressure in the range of from subatmospheric pressure upwardly to about 500 psia, and a weight hourly space velocity in the range upwardly to about 1000 $hour^{-1}$.

22. An aromatization process as recited in claim 21 wherein said cracked gasoline feedstock is derived from the fluidized catalytic cracking of a gas oil and has a boiling range of from about 80° F. to about 430° F.

23. An aromatization process as recited in claim 22 wherein the concentration of the tin in said catalyst is in the range of from about 0.05 to about 8 weight percent of said catalyst.

24. An aromatization process as recited in claim 23 wherein the concentration of the tin in said catalyst is in the range of from 0.1 to 6 weight percent of said catalyst.

25. An aromatization process as recited in claim 24 wherein the process conditions include a contacting temperature in the range of from about 400° C. to about 800° C., a contacting pressure in the range of from subatmospheric pressure upwardly to about 500 psia, and a weight hourly space velocity in the range upwardly to about 1000 $hour^{-1}$.

26. An aromatization process as recited in claim 25 wherein said cracked gasoline feedstock is derived from the fluidized catalytic cracking of a gas oil and has a boiling range of from about 80° F. to about 430° F.

* * * * *